US006869328B2

(12) United States Patent
Ulm et al.

(10) Patent No.: US 6,869,328 B2
(45) Date of Patent: Mar. 22, 2005

(54) ELECTRODES, METHOD FOR PRODUCTION THEREOF AND SPARK PLUGS WITH SUCH AN ELECTRODE

(75) Inventors: Heinz Ulm, Kunreuth (DE); Jochen Fischer, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 141 days.

(21) Appl. No.: 10/048,652

(22) PCT Filed: Mar. 30, 2001

(86) PCT No.: PCT/DE01/01268

§ 371 (c)(1),
(2), (4) Date: Jun. 10, 2002

(87) PCT Pub. No.: WO01/95447

PCT Pub. Date: Dec. 13, 2001

(65) Prior Publication Data

US 2002/0171346 A1 Nov. 21, 2002

(30) Foreign Application Priority Data

Jun. 3, 2000 (DE) ..... 100 27 651

(51) Int. Cl.[7] ..... H01T 21/02
(52) U.S. Cl. ..... 445/7; 313/141; 313/118
(58) Field of Search ..... 445/46, 49, 35, 445/7; 123/153, 169 EL, 163; 313/141, 140, 143, 118

(56) References Cited

U.S. PATENT DOCUMENTS 4,670,684 A * 6/1987 Kagawa et al. ..... 313/141
5,465,022 A * 11/1995 Katoh et al. ..... 313/144
6,346,766 B1 * 2/2002 Kanao et al. ..... 313/141

FOREIGN PATENT DOCUMENTS

| | | |
|---|---|---|
| DE | 199 2 925 | 11/1999 |
| DE | 100 11 705 | 9/2001 |
| EP | 0 785 604 A1 | 7/1997 |
| EP | 0 866 530 | 9/1998 |
| EP | 0 785 604 B1 | 5/1999 |

* cited by examiner

*Primary Examiner*—Edward J. Glick
*Assistant Examiner*—Elizabeth Keaney
(74) *Attorney, Agent, or Firm*—Kenyon & Kenyon

(57) ABSTRACT

An electrode and spark plug for an internal combustion engine including an electrode of this type as a center electrode. The electrode includes an electrode base element made of a first material and an end section that is integrally joined to the electrode base element, with this end section including a first area that is integrally joined to the first material and is made of a platinum-containing material and including a second area that is integrally joined to the first area and is made of an iridium-containing and/or ruthenium-containing material. In a method for manufacturing an electrode of this type, a first recess is stamped in the electrode base element, a first preform is inserted into the first recess, the first preform is melted, thereby forming a first alloy, a second recess is stamped in an area of the first alloy, a second preform is inserted into the second recess, and the second preform is melted, thereby forming a second alloy.

11 Claims, 2 Drawing Sheets

ELECTRODES, METHOD FOR PRODUCTION THEREOF AND SPARK PLUGS WITH SUCH AN ELECTRODE

FIELD OF THE INVENTION

The present invention relates to an electrode, a spark plug for an internal combustion engine including the electrode as a center electrode, and a method for manufacturing the electrode.

BACKGROUND INFORMATION

The service life requirements of spark plugs for internal combustion engines are increasing steadily, since manufacturers often strive for replacement intervals of 60,000 km to 100,000 km in motor vehicles. Such replacement intervals can be achieved, at least in the case of the conventional triple-electrode spark plugs, only by using noble-metal alloys such as platinum alloys or iridium alloys in the electrode area, in particular the center electrode, and applying or attaching these alloys to the electrodes, i.e., nickel-alloy electrode materials, commonly used by extrusion, plating, resistance welding, laser welding or laser alloying. However, these methods of joining the noble metal alloy to the nickel alloy require highly sophisticated process engineering techniques, since the properties of platinum, and especially iridium, alloys differ enormously from those of nickel alloys in terms of their melting and boiling points as well as thermal expansion coefficients. In addition, preforms, such as pins made, in particular of iridium alloys, are very expensive to manufacture, due to their low ductility.

A spark plug for an internal combustion engine, which has a center electrode made of an electrode base element and a noble metal tip that is attached to the end face of the electrode base element facing the combustion chamber, is described in European Published Patent Application No. 0 785 604. The end section of the electrode base element on the combustion chamber end is also in the shape of a frustum. The noble metal tip according to European Published Patent Application No. 0 785 604, is further applied to the electrode base element by laser welding or resistance welding and is made of a platinum alloy or an iridium alloy, while the electrode base element is made of a nickel alloy with a core made of a heat-conductive material.

The design of the noble metal tip in the shape of a frustum is also described in German Published Patent Application No. 100 11 705. This publication further describes the use of a metal alloy, with ruthenium as the primary component, as a spark erosion-resistant electrode material for spark plugs.

An electrode material in the form of a metal alloy that is particularly suitable for use in spark plugs is described in European Published Patent Application No. 0 866 530. This material is a metal alloy with iridium as the primary component and additional noble metals, such as rhodium, ruthenium or rhenium, as secondary components.

It is thus conventional that iridium alloys and ruthenium alloys are suitable for use as electrode materials in spark plugs, due to their extremely high melting points and associated erosion resistance. A process is also described whereby preferably rhodium is added by alloying to iridium, due to the latter's poor oxidation stability. However, alloys of this type are very brittle and thus very expensive to work, which means that the manufacture of preforms, such as pins or disks, which are subsequently to be joined—particularly by welding—to conventional electrode base elements made, for example, of nickel, is very costly.

SUMMARY

An example embodiment of an electrode according to the present invention and an example embodiment of a method according to the present invention for manufacturing an electrode of this type may provide the advantage that they enable very long-lived spark plugs to be manufactured with simple engineering process techniques, with the spark plug having a noble metal alloy at least in the region of the spark gap of the spark plug.

With the method according to the present invention, spheres made of a material containing platinum or iridium and/or ruthenium may be used as the preforms, for it is possible for these spheres to be manufactured relatively economically from these materials, i.e., alloys, as opposed to pins or disks.

In addition, less ruthenium and, for example, iridium or an iridium-rhodium alloy may need to be used as the material, compared to conventional electrodes with noble metal alloys of this type, since only the second area is made of an iridium-containing or ruthenium-containing material, while the first area, which is integrally joined to this second area, and which, in turn, is connected to the electrode base element, is made of a platinum-containing material. For example, platinum may be less expensive than iridium or rhodium.

The electrode according to the present invention and the method according to the present invention for manufacturing the electrode may provide the further advantage that, by melting the first preform, thereby forming a first alloy, and by melting the second preform, thereby forming a second alloy, blends or the formation of blended alloy zones may be produced by the melting steps at least in the boundary areas between the volume occupied by the first preform and the electrode base element, or between the volume occupied by the second preform and the volume occupied by the first preform, with these alloy zones producing a continuous transition in composition between adjacent materials.

Because, on the one hand, the thermal expansion coefficients of iridium and nickel vary enormously, direct connections between these materials tend to crack apart with the temperature changes that frequently occur in internal combustion engines. Because the thermal expansion coefficient of platinum, on the other hand is between those of iridium and nickel, the two melting steps in the method according to the present invention may produce a continuous transition between thermal expansion coefficients even in the transitional zones, i.e., the blended alloy zones, so that the connections created are highly stable, particularly in the blended alloy zones, and do not tend to crack apart.

The electrode according to the present invention and the method according to the present invention may provide the ability to bypass the boiling point of nickel, which is close to the melting point of iridium. Direct laser welding or laser alloying of iridium and nickel may cause the nickel to evaporate, since the high melting point of iridium makes it necessary to generate a high temperature to achieve metallurgical fusing between these two materials. However, because the electrode base element in the electrode according to the present invention is first integrally joined to a first area made of a platinum-containing material, and this first area is then integrally joined to a second area made of an iridium-containing and/or ruthenium-containing material, and the melting point of platinum is between those of iridium and nickel, this problem may no longer occur in the electrode according to the present invention and the method according to the present invention, respectively. In particular, the melting point of the platinum-containing material in the first area is between the melting point of the first material of the electrode base element and the iridium-containing or ruthenium-containing material of the second area.

While iridium alloys may be difficult to work, platinum alloys may not have this disadvantage. In the case of the electrode according to the present invention, therefore, both the electrode base element and the end section integrally joined thereto including the first area and the second area, may be shaped, for example, by cutting, without any process engineering difficulties, with it being possible to variably and, at the same time, accurately machine, for example, the end sections of the electrode. The latter may thus be easily manufacturable in more or less any shape, such as, for example, a frustum. A shape of this type for the end section may be advantageous with regard to the service life, flammability and heat dissipation of the electrode according to the present invention and the spark plug manufactured therewith, respectively.

The electrode base element may be made of a nickel alloy, at least in one region of the end section, the first area to be made of an alloy of nickel and platinum, and the second area to be made of an alloy of nickel, platinum and iridium. The electrode base element itself may include, for example, a tapered tip, for example, in the shape of a cone or frustum, with the end section being attached to its end face so that the end face is integrally joined to the first area of the end section.

According to the method for manufacturing an electrode, the first recess and/or the second recess may be a dome-shaped recess that may be produced, for example, by stamping with a sphere or hemisphere.

In addition, the preform that may be inserted into this first recess or this second recess may be a sphere, the volume of which is selected so that the volume of the sphere is approximately identical to the volume of the first recess and the second recess, respectively.

A laser beam directed frontally onto the end face of the electrode base element, which is used in a conventional manner, may be suitable for melting the first preform inserted into the first recess and the second preform inserted into the second recess, respectively. This laser beam is used in a laser alloying process, i.e., melting the first preform in the first recess with the laser beam produces a first alloy from the material of the first preform and the material of the electrode base element, and melting the second preform in the second recess with the laser beam produces a second alloy from the first alloy and the material of the second preform.

DETAILED DESCRIPTION

Figure 1:
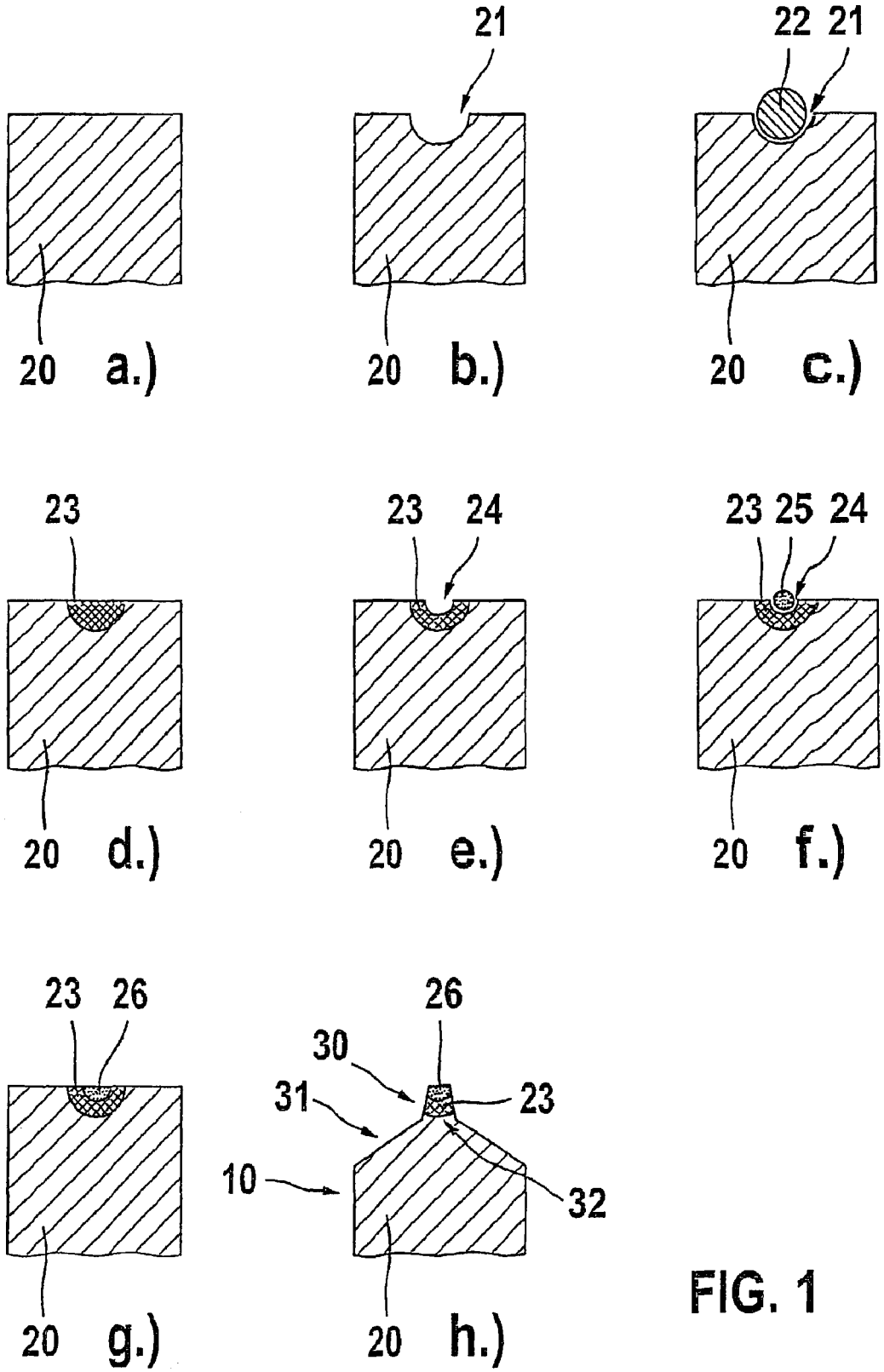
FIGS. 1*a* to 1*h* illustrate the method steps in the manufacture of an electrode in the form of a center electrode for a spark plug.

FIG. 1*a* illustrates a conventional electrode base element 20 made of a nickel alloy, such as that frequently used as the material for the center electrode in spark plugs. Electrode base element 20, illustrated in FIG. 1*a*, is configured in a conventional manner in the shape of a pin with a cylindrical cross section at least in the area that, in a spark plug subsequently manufactured therewith, is located in the spark gap region. FIG. 1*b* illustrates the next method step in which a dome-shaped first recess 21 is created in an end face of electrode base element 20, using a suitable stamping die. This dome-shaped first recess 21 is, for example, approximately 1 mm deep and has a circular cross-section with a diameter of approximately 1.5 mm, when viewed from above.

FIG. 1*c* illustrates how a sphere as first preform 22, which is made of a platinum alloy is inserted into this created first recess 21. Following the insertion of this first preform 22, a laser beam is directed frontally onto the end face of electrode base element 20 so that first preform 22, including an edge region of first recess 21, is melted, thus forming a first area 23 that is made of a first alloy and contains both platinum and nickel. The volume of first preform 22 is a least approximately the same as the volume occupied by first recess 21. During melting of first preform 22, the material of electrode base element 20 is also blended with the platinum alloy of which first preform 22 is made, in the region of the boundary surface between first area 23 and electrode base element 20, so that a blended alloy zone forms in this region.

The laser beam used thus generally forms an alloy, by laser alloying, from the material of electrode base element 20 and the platinum alloy of first preform 22, at least in the area of the blended alloy zone.

In addition, this laser alloying process may be performed, and the platinum alloy of which first preform 22 is made may be selected, so that a first alloy containing the platinum and nickel in a ratio of 70 to 30 exists in first area 23 following laser alloying.

FIG. 1*e* illustrates the step that follows that illustrated in FIG. 1*d*, in which a second dome-shaped recess 24 is produced, for example, in the center of the area of the end face of electrode base element 20 that is occupied by first area 23. Like first recess 21, this second recess 24 is produced by stamping with a suitable stamping die. Second recess 24 is, for example, approximately 0.5 mm deep and has a diameter of, for example, approximately 0.8 mm, viewing the end face of electrode base element 20 from above.

As illustrated in FIG. 1*f*, a second preform 25 in the shape of a sphere and made of an iridium alloy is inserted into this second recess 24. A laser beam is again directed frontally onto the end face of electrode base element 20 so that inserted second preform 25 and an edge area of second recess 24 melt and form a second area 26. In this case, the volume of second preform 25 is selected so that it may be, for example, at least approximately the same as the volume of second recess 24, with second recess 24 thus being at least almost completely filled by molten second preform 25 after melting. When melting second preform 25 using the laser, a material blend, i.e., a laser alloy, is produced at least in the boundary area between first area 23 and second preform 25, so that a blended alloy zone once again forms at least in this region. This may ensure that the first alloy present in first area 23 is blended, i.e., alloyed, with the iridium alloy of second preform 25, at least in the edge area of recess 24 so that, after melting second preform 25, the volume previously occupied by second recess 24 is made, at least in certain areas, of an alloy that contains both platinum and iridium.

In addition to platinum and iridium, second area 26 may also contain an alloyed nickel that originated from the first material of electrode base element 20.

Second preform 25 may be melted, i.e., the associated laser alloying process is performed, so that an alloy of the iridium alloy of which second preform 25 was made and the platinum-nickel alloy of which first area 23 was made, is formed in second area 26. This alloy, which contains both iridium and platinum as well as nickel, may have a ratio, for example, of 80 to 20 between the iridium and the platinum-nickel alloy from first area 23.

After, as illustrated in FIG. 1*g*, both first area 23 and second area 26 have been produced in electrode base element 20, with second area 26 being entirely contained within first area 23, electrode base element 20, first area 23 and second area 26 are subsequently shaped by cutting.

This cutting method of shaping first produces, as illustrated in FIG. 1*h*, a tapered, frustum-shaped tip 31 of electrode base element 20, which then merges with an end section 30 formed by first area 23 and second area 26. Furthermore, this end section 30 may also be configured at least in the approximate shape of a frustum and be integrally joined to electrode base element 20, for example, tip 31, in the area of an end face 32.

In this manner, electrode base element 20 is first integrally joined, in the area of end face 32, to first area 23, which, in turn, is integrally joined to second area 26.

Figure 2:
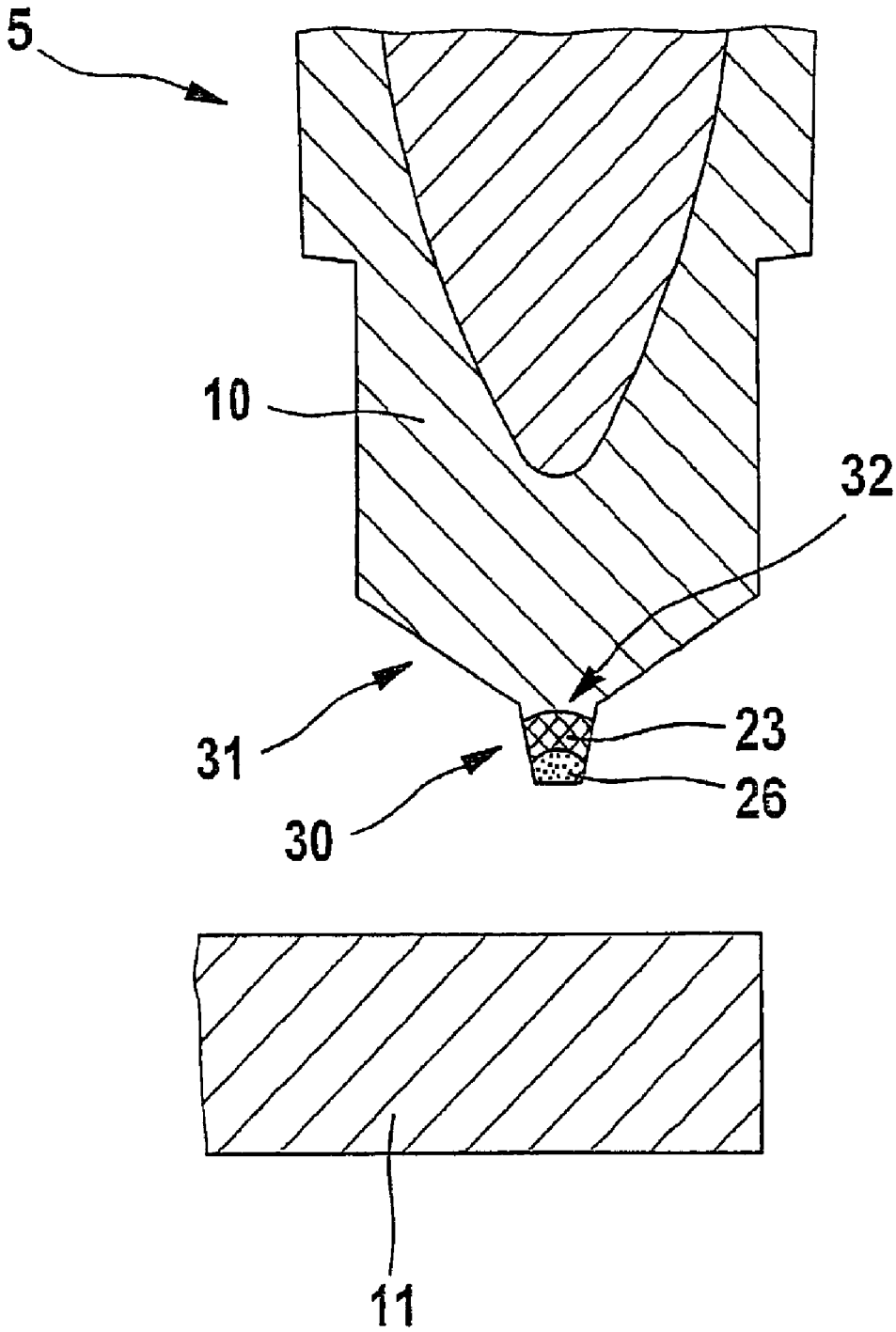
FIG. 2 is a cross-sectional view of an extract of a spark plug including a center electrode of this type in the spark gap area.

FIG. 2 illustrates a center electrode 10, prepared according to the method steps illustrated in FIGS. 1*a* to 1*h*, in a spark plug 5. Center electrode 10 is integrated into spark plug 5 so that second area 26 is opposite a ground electrode 11 and is separated from the latter by a spark gap in a conventional manner. Second area 26, as illustrated in FIG. 2, is also integrally joined to first area 23, while first area 23 is integrally joined to tip 31 of electrode base element 20 of center electrode 10.

Other conventional details of spark plug 5 are not discussed further.

As illustrated in FIG. 2, therefore, a spark plug 5 with a pointed center electrode 10 is produced, including a frustum-shaped end made from end section 30. In second area 26, this end section 30 is made of an iridium alloy to which a platinum-nickel alloy is added by alloying. First area 23, which is made of a platinum-nickel alloy, is thus located between second area 26 and electrode base element 20. Finally, electrode base element 20 is made of a nickel alloy.

What is claimed is:

1. A method for manufacturing an electrode for use in a spark plug, the method comprising the steps of:

preparing an electrode base element from a first material;

stamping a first recess in an end face of the electrode base element;

inserting a first preform into the first recess;

melting the first preform in the first recess, to form a first alloy including a material of the first preform and a material of the electrode base element;

stamping a second recess in an area of the end face of the electrode base element occupied by the first alloy of the material of the first preform and the material of the electrode base element;

inserting a second preform into the second recess; and melting the second preform in the second recess, to form a second alloy of the first alloy and a material of the second preform.

2. The method according to claim 1, wherein at least one of a volume occupied by the first recess is at least approximately the same as a volume of the first preform and a volume occupied by the second recess is at least approximately the same as a volume of the second preform.

3. The method according to claim 1, wherein at least one of the first and the second preform is melted in the first melting step with a laser beam directed onto the end face of the electrode base element.

4. The method according to claim 1, wherein at least one of the first alloy and the second alloy is formed by laser alloying.

5. The method according to claim 1, wherein the second recess is stamped in the second recesses stamping step so that it is completely within a volume occupied by the first alloy.

6. The method according to claim 1, further comprising the step of, after the second preform step, cutting to produce a tip of the electrode base element that tapers, the tip including an end face integrally joined to a first area made of the first alloy, the first area integrally joined to a second area made of the second alloy.

7. The method according to claim 6, wherein the cutting step is performed so that the first area and the second area integrally joined thereto together have at least an approximate shape of one of a frustum, a cone and a cylinder, the second area separated from the tip of the electrode base element by the first area.

8. The method according to claim 1, wherein at least one of the first recess and the second recess is domed-shaped.

9. The method according to claim 1, wherein the first preform includes a first sphere.

10. The method according to claim 1, wherein the second preform includes a second sphere.

11. The method according to claim 1, wherein the electrode includes a center electrode for a spark plug.

* * * * *